US007921568B2

(12) United States Patent
Green

(10) Patent No.: US 7,921,568 B2
(45) Date of Patent: Apr. 12, 2011

(54) FOUR POINT UTILITY BLADE

(75) Inventor: Matthew C. Green, Amherst, MA (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 11/409,459

(22) Filed: Apr. 20, 2006

(65) Prior Publication Data

US 2007/0245574 A1 Oct. 25, 2007

(51) Int. Cl.
*B26B 1/08* (2006.01)

(52) U.S. Cl. ..... 30/346.52; 30/346.53; 30/346.55; 30/346.59; 30/346.61; 76/104.1

(58) Field of Classification Search ..... 76/104.1; 30/346.5, 346.53–346.61, 350–351
See application file for complete search history.

(56) References Cited

U.S. PATENT DOCUMENTS

| | | | | | |
|---|---|---|---|---|---|
| 1,734,554 | A | | 11/1929 | Behrman | |
| 2,319,607 | A | | 5/1943 | Kevorkian et al. | |
| 3,439,419 | A | * | 4/1969 | Fleming | 30/162 |
| 3,448,518 | A | * | 6/1969 | Sklar | 30/162 |
| 3,889,368 | A | * | 6/1975 | Himeno | 30/162 |
| 4,170,062 | A | * | 10/1979 | Machida | 30/162 |
| 4,232,445 | A | * | 11/1980 | Ito | 30/162 |
| 4,233,734 | A | | 11/1980 | Bies | |
| 4,240,202 | A | | 12/1980 | Gilbert | |
| 4,292,738 | A | * | 10/1981 | Osada | 30/162 |
| 4,322,885 | A | * | 4/1982 | Osada | 30/162 |
| 4,729,168 | A | * | 3/1988 | Yeh | 30/162 |
| 4,794,692 | A | | 1/1989 | Wang | |
| 5,103,564 | A | * | 4/1992 | MacDonald | 30/351 |
| 5,269,063 | A | * | 12/1993 | Okada | 30/162 |
| 5,337,482 | A | * | 8/1994 | Schmidt | 30/162 |
| 5,581,890 | A | * | 12/1996 | Schmidt | 30/162 |
| D400,067 | S | | 10/1998 | Gold | |
| 5,909,930 | A | * | 6/1999 | Ragland et al. | 30/125 |
| 6,226,873 | B1 | * | 5/2001 | Okumura | 30/162 |
| 6,324,762 | B1 | * | 12/2001 | Huang | 30/125 |
| D455,057 | S | | 4/2002 | Medhurst | |
| 6,510,612 | B1 | * | 1/2003 | Cybulski | 30/162 |
| D479,108 | S | | 9/2003 | Schmidt | |
| 6,701,627 | B2 | * | 3/2004 | Korb et al. | 30/350 |
| 6,718,640 | B1 | | 4/2004 | John | |
| 6,938,345 | B2 | * | 9/2005 | Yu | 30/123 |
| D527,234 | S | | 8/2006 | Weremchuk et al. | |

(Continued)

FOREIGN PATENT DOCUMENTS

DE 19 24 296 U 9/1965

*Primary Examiner* — Maurina Rachuba
(74) *Attorney, Agent, or Firm* — McCarter & English, LLP

(57) ABSTRACT

A utility blade for use with conventional retractable and fixed blade utility knives comprising a blade body having a generally trapezoidal configuration defined by a cutting edge, an opposite back edge, a pair of opposing side edges and a pair of cutting points defined by the points of intersection between the side edges and the cutting edge. The blade further defines a pair of score lines, each proximate to one of the side edges. The score lines enable the user to remove a dulled or damaged cutting point, which in turn provides the user with two additional cutting points defined by the points of intersection between the score lines and the cutting edge. Further, the blade is configured with one or more notches strategically located on the back edge of the blade, such that each cutting point can extend from the utility knife at approximately the same distance.

35 Claims, 7 Drawing Sheets

U.S. PATENT DOCUMENTS

| | | | | |
|---|---|---|---|---|
| 7,208,216 | B2 * | 4/2007 | Ackerman et al. | 428/137 |
| D562,651 | S | 2/2008 | Harkey | |
| D568,126 | S | 5/2008 | Allem | |
| D582,229 | S | 12/2008 | Johnson | |
| 2003/0019111 | A1 * | 1/2003 | Korb et al. | 30/351 |
| 2003/0019332 | A1 * | 1/2003 | Korb et al. | 76/104.1 |
| 2004/0168326 | A1 * | 9/2004 | Korb et al. | 30/350 |
| 2004/0244539 | A1 * | 12/2004 | Korb et al. | 76/104.1 |
| 2005/0022390 | A1 | 2/2005 | Whitemiller et al. | |
| 2005/0050734 | A1 | 3/2005 | Kesinger | |
| 2007/0101576 | A1 * | 5/2007 | Green | 30/62 |
| 2007/0227012 | A1 | 10/2007 | Constantine et al. | |
| 2007/0245574 | A1 | 10/2007 | Green | |
| 2009/0106909 | A1 | 4/2009 | Tyers | |

* cited by examiner

FOUR POINT UTILITY BLADE

FIELD OF THE INVENTION

The present invention relates to utility knife blades and, more particularly, to conventional utility knife blades having one or more score lines that allow the user to snap off a dulled point in a relatively precise location, thereby providing the user with more than two useful cutting points.

BACKGROUND

Conventional utility knives having disposable utility blades are well known in the art. These knives have many industrial as well as home uses, such as for opening boxes, cutting cord, or carving wall board or wood. A typical utility knife has a plastic or metal handle with either a fixed or retractable utility blade mounted therein. When in use, the blade is positioned to extend outwardly from the handle, exposing the cutting edge and one of the cutting points of the blade.

Utility knife blades come in a variety of shapes depending upon the intended use. As shown with reference to FIG. 1, a conventional utility blade has a generally trapezoidal shape that includes a back edge, a cutting edge and two side edges. The trapezoidal shaped blades are the most popular because they define sharp acute angled cutting points or tips formed at the intersections between the side edges and the cutting edge. These sharp points or tips enable a user to puncture through a material which is desired to be cut, such as sealing tape closing a box or the cardboard defining the box. Once the object has been punctured, the user can slice open the material by dragging the knife along the surface of the material and allowing the cutting edge cut through the material.

Although trapezoidal utility blades are preferred for the reasons described above, they offer the disadvantage that the tips will dull or become damaged over a period of repeated uses, rendering the blade worn out or spent. When this occurs, users that require a sharply pointed blade cutting tip will either replace the blade with a new blade, which adds to overall supply costs and material waste, or, to save money, will attempt to prolong the useful life of a spent blade by manually snapping or snipping off the end of a dulled point blade, effectively creating a new sharp cutting point. This practice is particularly cumbersome because the user has little control over where the blade will actually snap; additionally, such a practice creates a safety hazard, as the blade can shatter and project sharp metallic pieces that could harm the user or bystander. Furthermore, this practice is even more cumbersome with respect to bi-metal utility blades because the tip will not snap off manually thereby requiring the use of a cutting tool to renew the tip.

To address this disadvantage, conventional snap-off style utility blades have been developed that employ an elongated blade having a plurality of blade segments separated by score lines that allow the user to snap off a spent blade segment at the respective score line. However, such snap-off style utility blades require a specialized blade holder and utility knife housing to secure, move and index the blade, and cannot be used with conventional retractable and fixed blade utility knives that use conventional trapezoidal utility blades.

There is a need, therefore, for an improved utility knife blade that overcomes one or more of the above-described drawbacks and/or disadvantages of conventional prior art utility knife blades and conventional prior art snap-off style utility knife blades.

SUMMARY

The utility blade herein described is designed for use with conventional retractable and fixed blade utility knives and provides the user with more than two, and in one embodiment, four useful cutting points as opposed to the standard two cutting points found in conventional trapezoidal utility blades (FIG. 1). With the availability of more than two cutting points, the life of an individual blade is prolonged, which in turn, reduces supply costs and material waste. Additionally, the blade may be configured with indexing notches that are strategically located so that each of the cutting points, when in use, will extend from the utility knife at about the same distance to provide the user with a consistent cutting edge and maintain blade stability, feel and control during use.

In accordance with one aspect of the utility knife blade herein described, the blade includes a generally planar blade body having a substantially trapezoidal peripheral configuration. The blade body defines a back edge, a cutting edge located on an opposite side of the blade body relative to the back edge, and two side edges located on opposite sides of the blade body relative to each other and extending between the back and cutting edges of the blade body. The intersection of each side edge with the cutting edge forms a first cutting point and a second cutting point. The utility blade further includes at least one score line and at least one removable cutting segment, thereby providing an additional cutting point when the segment is removed. In one embodiment, the blade includes a first score line and a second score line, each score line proximate to one of the side edges, and two removable cutting segments. Each cutting segment is defined by the area of the blade body between one of the score lines and the side edge proximate to the respective score line. The intersection of each score line and the cutting edge forms a third cutting point and a fourth cutting point when each of the respective cutting segments is removed.

According to another aspect of the utility knife blade herein described, each score line extends from either the cutting edge to the back edge, from the cutting edge to the side edge proximate to the respective score line, from the cutting edge to the point of intersection between the back edge and the side edge proximate to the respective score line, or any combination thereof. The utility blade further defines at least one notch formed in the back edge of the blade body.

In yet another aspect of the utility knife blade herein described, the blade further includes at least two, and in one embodiment, at least four notches formed in the back edge of the blade body and having a center point, wherein the notches are laterally spaced relative to each other. The blade further defines a distance D1 between at least one of the first and second cutting points and a blade aperture defined by the utility knife that the blade is mounted into, and a distance D2 between the center points of the notches. Still further, the blade defines a distance D3 between the first cutting point and a point defined by the intersection of the first score line and the cutting edge, as well as the distance between the second cutting point and a point defined by the intersection of the second score line and the cutting edge. The blade is configured so that D2 and D3 are approximately equal to one another such that, upon removal of the cutting segments, the blade can be indexed a distance D4, which is approximately equal to D1, so that the third and forth cutting points can extend from the blade aperture at approximately the same distance D1 that the first and second cutting points extend from the same utility knife. In one embodiment, D2 and D3 are approximately 0.1 to 0.5 inch.

In still another aspect of the utility knife blade herein described, each side edge and score line intersects the cutting edge at an acute angle, while the cutting edge defines an approximately straight edge extending from approximately one side edge of the blade to the other side edge, and at least two facets formed on opposite sides of the blade relative to each other.

In a further aspect of the utility knife blade herein described, the blade comprises first and second metal portions. The first metal portion extends between the back edge and the second metal portion, and extends from approximately one side edge to the other side edge, and the second metal portion defines the cutting edge and extends from approximately one side edge to the other side edge. In this embodiment, the first metal portion is formed of a steel heat treated to a hardness within the range of approximately 38 Rc to approximately 52 Rc, and the second metal portion is formed of a tool steel heat treated to a hardness within the range of approximately 60 Rc to approximately 75 Rc. The first and second metal portions are joined at a weld region that extends from approximately one side edge of the blade to the other side edge of the blade.

One advantage of the utility knife blade herein described is that the blade provides more than two useful cutting points to the user and can be used with any conventional retractable blade and fixed blade utility knife. A further advantage of the currently preferred embodiments of the blade is that when a cutting segment is broken off at the score line, which in turn provides a fresh cutting point, the blade can be indexed or advanced forward so that the fresh cutting point protrudes from the knife opening at the standard blade extension; i.e., the fresh cutting point will extend from the utility knife at approximately the same distance as the previously broken off cutting point.

Other aspects and advantages of the present invention and/or of the currently preferred embodiments thereof will become more readily apparent in view of the following detailed description and accompanying drawings.

DETAILED DESCRIPTION

Figure 3:
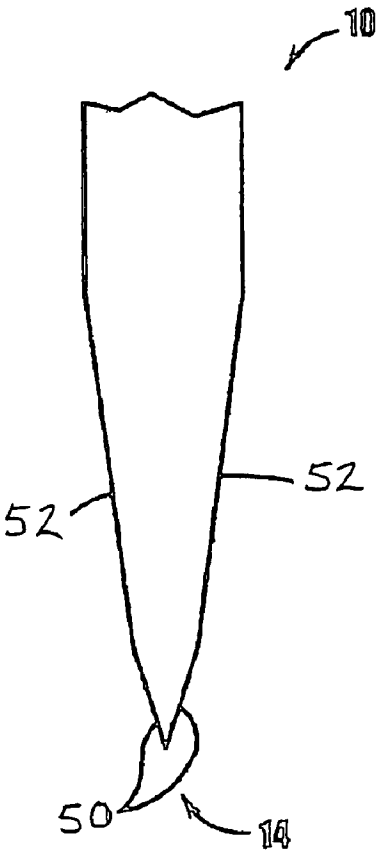
FIG. 3 is a partial, end elevational view of the utility knife blade of FIG. 2 showing the multi-faced cutting edge of the blade.
Figure 2:
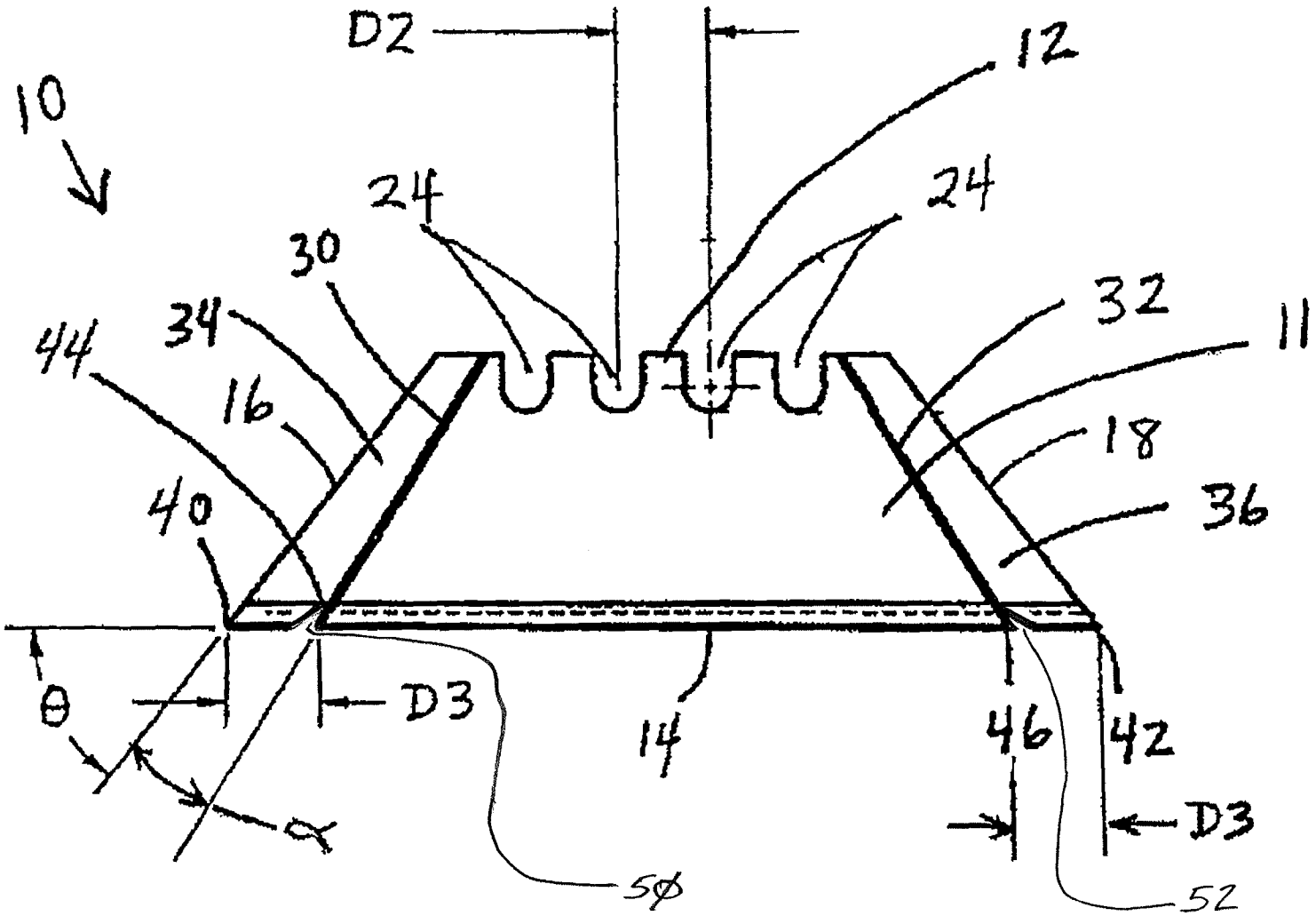
FIG. 2 is a side elevational view of an embodiment of a utility knife blade of the present invention.
Figure 4:
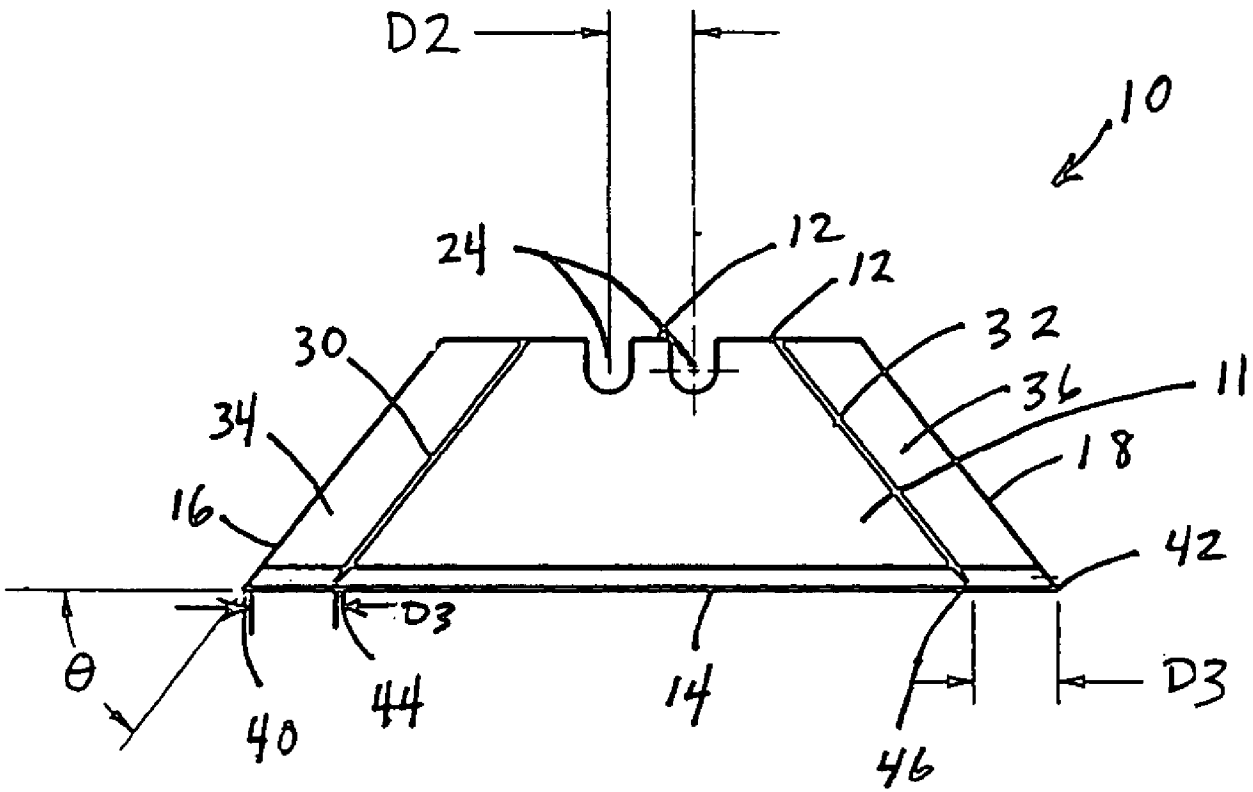
FIG. 4 is side elevational view of another embodiment of the utility knife blade of the present invention.
Figure 5:
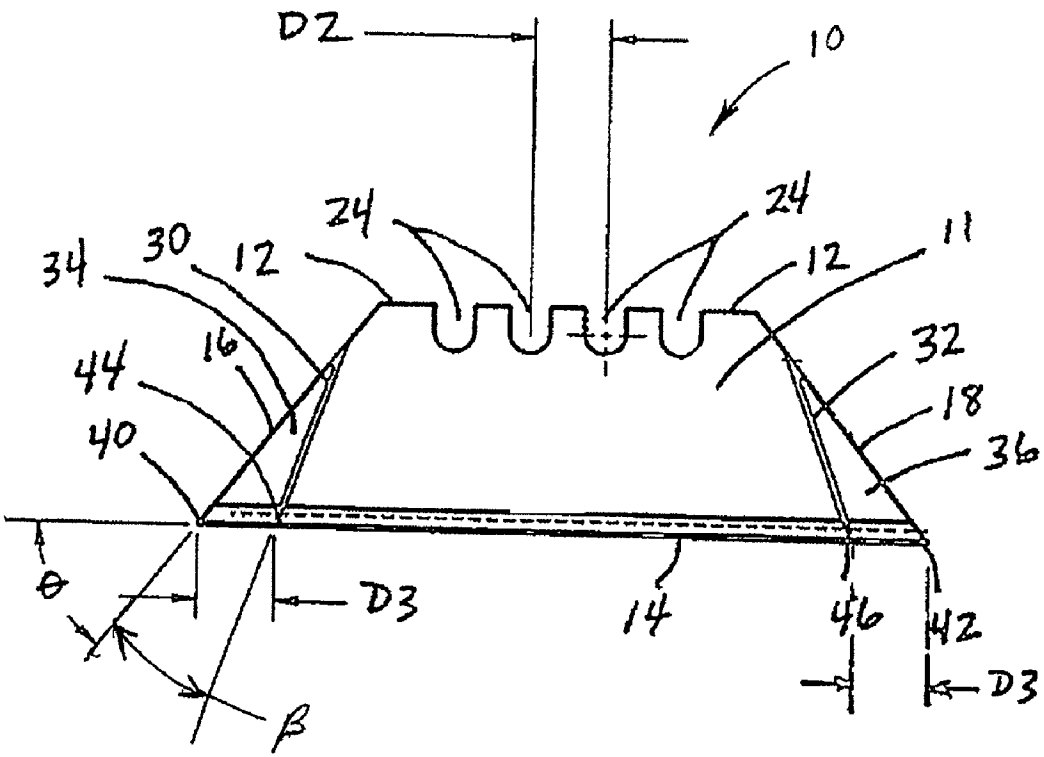
FIG. 5 is side elevational view of another embodiment of the utility knife blade of the present invention.

In FIGS. 2, 4 and 5, a four-point or "Snap Trap™" utility knife blade herein described is indicated generally by the reference numeral 10. The blade is completely usable with conventional industry standard retractable and fixed blade utility knives that utilize conventional trapezoidal utility blades, but can also be used with additional utility knives and holders that are currently known or later become known. The utility knife blade 10 comprises a generally planar blade body 11 that defines a back edge 12, a cutting edge 14 located on an opposite side of the blade relative to the back edge, and two side edges 16, 18 located on opposite sides of the blade relative to each other and extending between the back and cutting edges of the blade 10. The intersection of each side edge 16, 18 and the cutting edge 14 forms a pair of primary cutting points, first cutting point 40 and second cutting point 42 respectively, which are typically used for cutting and puncturing work pieces. In one embodiment, the side edges 16, 18 intersect the cutting edge 14 at an acute angle θ in the range of 22 to 82 degrees, more preferably in the range of 32-72 degrees, and in an exemplary embodiment, the angle is approximately 52 degrees. As shown typically in FIG. 2, the back, cutting and side edges of the blade define an approximately trapezoidal peripheral configuration; furthermore, the cutting edge 14 defines an approximately straight edge extending from approximately one side edge 16 of the blade to the other side edge 18, and at least two facets 50, 52 (shown in FIG. 3) formed on opposite sides of the blade relative to each. However, the utility knife blade herein described may take any of numerous different shapes or configurations that are currently known or later become known, including, for example, a square or parallelogram shape, and can be single faceted or have more that two facets.

The blade 10 further defines a first score line 30 and a second score line 32, wherein each score line is proximate to one of the side edges 16, 18. The score lines 30, 32 are configured such that they extend from the cutting edge 14 of the blade to the back edge of the blade 12 (FIGS. 2 and 4), from the cutting edge 14 of the blade to the side edge 16, 18 of the blade proximate to the respective score line (FIG. 5), from the cutting edge 14 of the blade 10 to the point of intersection between the back edge and the side edge 16, 18 proximate to the respective score line (not shown), or any combination thereof. Drawing further attention to FIGS. 2 and 4, it should be noted that the score lines 30, 32 can run substantially parallel to the side edges 16, 18 (FIG. 4) or offset at an angle ranging from approximately 1-90 degrees (FIGS. 2 and 5). In the embodiment shown in FIG. 2, the score lines are offset at an angle α ranging from 1-30 degrees, more preferable from 2-10 degrees, and in an exemplary embodiment, the angle α is approximately 6 degrees. In the embodiment shown in FIG. 5, the score lines are offset at an angle β ranging from 1-37 degrees, more preferable from 9-27 degrees, and in an exemplary embodiment, the angle β is approximately 18 degrees.

Figure 1:
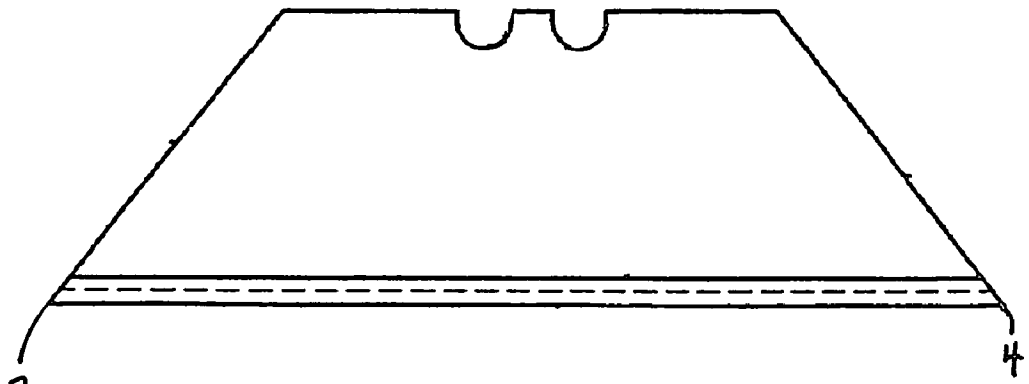
PRIOR ART FIG. 1
FIG. 1 is a side elevational view of a prior art trapezoidal utility knife blade.

With the score lines, the blade further defines two removable cutting segments 34, 36, each segment defined by the area of the blade body between one of the score lines and the side edge 16, 18 proximate to the respective score line. In this configuration, when either of the cutting segments 34, 36 becomes unusable due to dulling or breakage, the damaged or dulled segment may be manually snapped off at the respective score line 30, 32, subsequently exposing a pair of secondary cutting points, namely, third cutting point 44 and/or fourth cutting point 46. Each secondary cutting point 44, 46 is defined by the point of intersection between each score line 30, 32 and the cutting edge 14. With this configuration, the blade user is provided with four useful cutting points 40, 42, 44, 46 as opposed to the standard two cutting points 2, 4 found on conventional utility knife blades 1 (FIG. 1). It should be noted, however, that although the embodiments shown in FIGS. 2 and 4- through 6 include two score lines and two cutting segments (one score line and one cutting segment on each side of the blade), the blades can have only one score line and cutting segment, or two or more score lines and respective cutting segments, so long as the blade remains functional with conventional retractable and fixed blade utility knives.

To engage conventional retractable and fixed blade utility knives, the utility knife blade 10 includes at least one indexing notch 24 formed in the back edge 12 of the blade body 11. In one embodiment (FIG. 4), the blade 10 includes at least two notches 24 formed in the back edge 14 of the blade body 11, wherein each notch 24 defines a center point and the notches are laterally spaced relative to each other. In another embodiment (FIGS. 2 and 5), the blade 10 includes at least four notches 24 formed in the back edge 14 of the blade body 1l, wherein each notch 24 has a center point and the notches are laterally spaced relative to each other. As shown typically in FIGS. 2, 4 and 5, each notch 24 defines a concave, approximately semi-circular profile, and is adapted to engage a corresponding locator 90 (FIGS. 7- and 8) of a blade holder within a utility knife in order to retain the blade within the handle of the knife. As may be recognized by those skilled in the pertinent art based on the teachings herein, the notches 24 may take any of numerous different shapes and/or configurations, and the blade may include any number of such notches or other recesses that are currently or later become known to those skilled in the pertinent art for performing the function of engaging a blade holder, or the blade actuating mechanism or locator of such a holder for any and all conventional retractable and fixed blade utility knives that are currently known or later become known.

Figure 7:
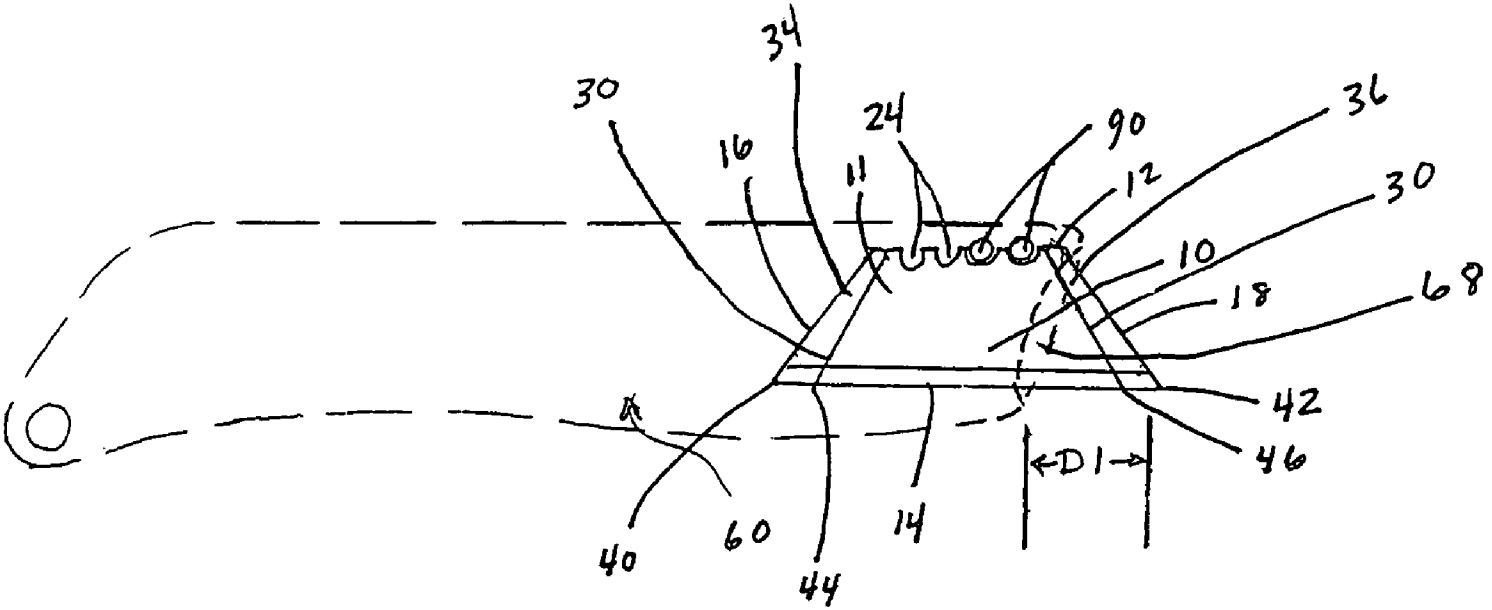
FIG. 7 is a side elevational view of the utility blade of FIG. 2 mounted to a conventional utility knife and indexed so that one of the primary cutting points is exposed.
Figure 8:
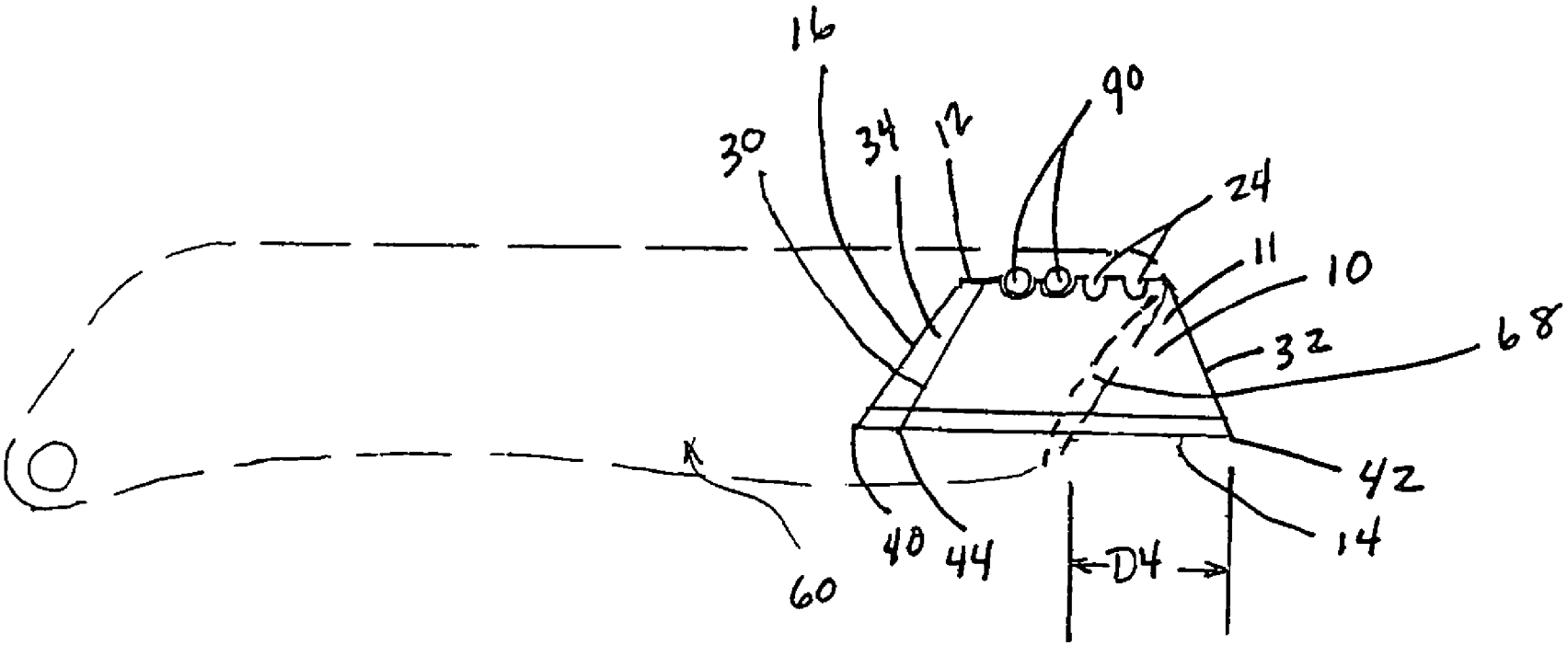
FIG. 8 is a side elevational view of the utility blade of FIG. 2 mounted to a conventional utility knife and indexed so that one of the secondary cutting points is exposed upon removal of a cutting segment.

With reference to FIGS. 2, 4, 5, 7 and 8, the characteristics of the blade 10 with respect to blade positioning and indexing in conventional retractable and fixed blade utility knives is hereinafter described. FIG. 7 illustrates the blade 10 of FIG. 2 seated within a utility knife handle 60 with the notches 24 of the blade engaging the blade-engaging locaters, tabs or catches 90 of the utility knife, wherein the first cutting point 40 is extended a distance D1 (described in further detail below) from a blade aperture 68 defined by the utility knife handle 60. When the extended portion of the cutting edge 14 of the blade 10 becomes damaged or dulled, the user can flip the blade over and use the other half of the blade, or the user can snap off the dulled segment at one of the score lines 30, 32 to expose one of the secondary cutting points 44, 46. As shown typically in FIGS. 7 and 8, and in contrast to prior art snap-off blade holders, the score lines 30, 32 are oriented transverse to the front edge of the utility knife handle defining the blade aperture 68. Further, as may be recognized by those of ordinary skill in the pertinent art based on the teachings herein, the utility blades 10 herein described are usable with any of the numerous different styles of conventional retractable and fixed blade utility knife configurations that are currently known or later become known.

The blade 10 defines a distance D1 (FIG. 7) between the first and second primary cutting points 40, 42 and the blade aperture 68 of the utility knife that the blade is mounted into (see FIGS. 7- and 8), and a distance D2 between the center points of the notches 24. Additionally, the blade 10 defines a distance D3 between the first cutting point 40 and the third cutting point 44, and between the second cutting point 42 and the fourth cutting point 46, respectively. In an exemplary embodiment, D2 and D3 are approximately equal so that when a primary cutting point 40, 42 becomes damaged or dulled and the respective cutting segment 34, 36 is removed, the blade 10 can be indexed or advanced forward such that the secondary (i.e., third and fourth) cutting point 44, 46 can extend from the blade aperture 68 a distance D4 (FIG. 8), which is approximately equal to the distance D1 (FIG. 7) that the first and second cutting points 40, 42 extend from the same blade aperture 68. This configuration provides a sharp cutting point, whether primary 40, 42, or secondary 44, 46, at approximately the same blade extension, which gives the user a consistent length of cutting edge to work with and better blade stability, feel and control during use. In one embodiment of the invention, D2 and D3 are approximately 0.1 to 0.5 inch, and in an exemplary embodiment, D2 and D3 are approximately 0.25 inch. It should be noted, however, that any of the aforementioned distances, D1, D2, D3 and D4, can be adjusted in any way and are not limited to the description above. Furthermore, in instances where more than two notches are employed, the distances between the center points of the notches can vary, whether the notches are spaced at equidistant intervals along the back edge or at random or non-equidistant intervals.

To assist the user in manually removing each of the cutting segments 34, 36 when the respective primary cutting points 40, 42 become dulled or damaged, the blade 10 can optionally include at least one notch 50, 52 formed at the juncture of the respective score line 30, 32 and cutting edge 14 to facilitate breaking off and removing the respective cutting segment 34, 36 from the blade 10. Additionally, the blade 10 can include at least one aperture 26 defined in the blade body for centering, stabilizing, and/or indexing the blade 10 relative the utility knife that the blade is mounted into, the function dependent upon the internal configuration of the knife.

Figure 6:
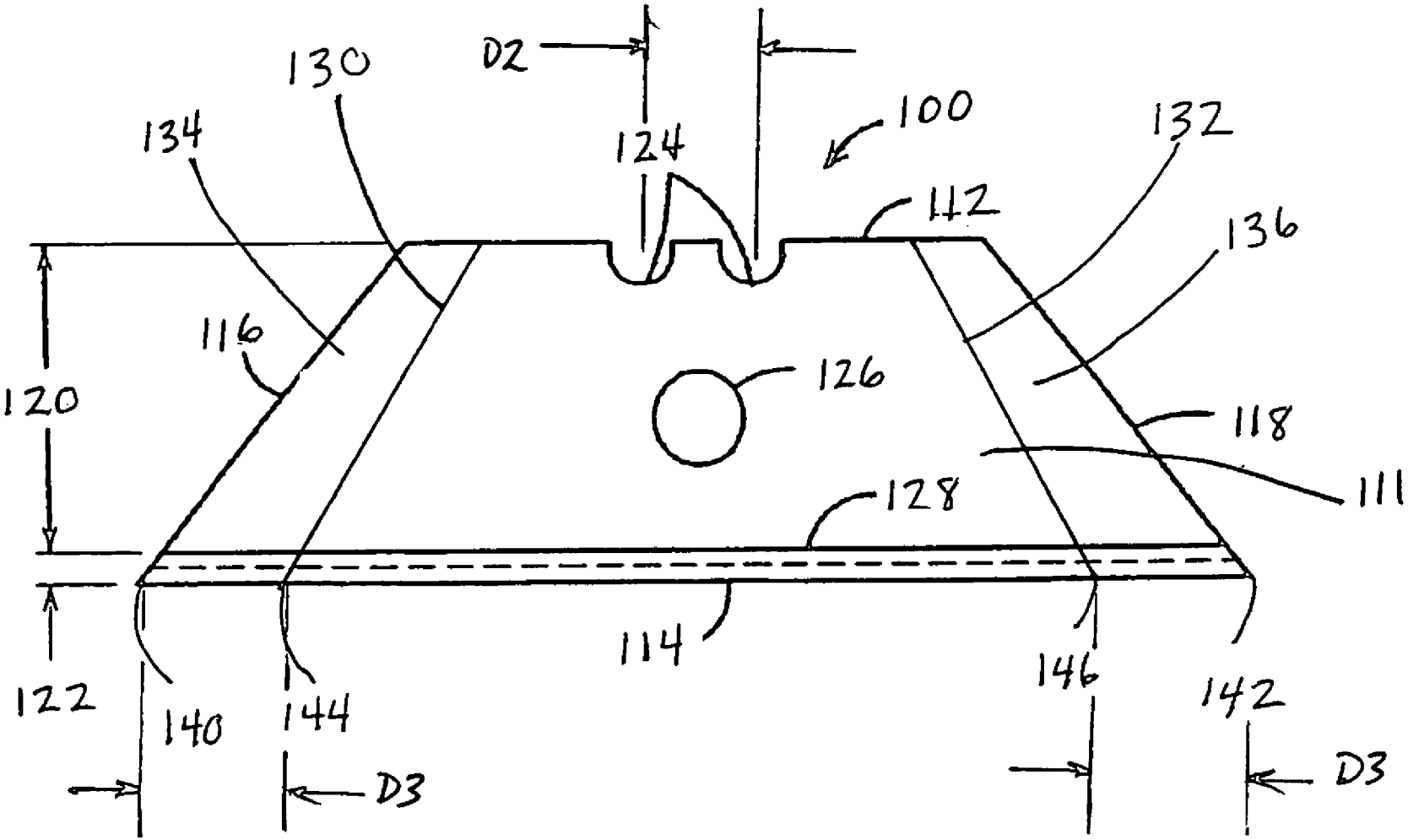
FIG. 6 is a side elevational view of a composite utility knife blade according to another embodiment of the invention.

In another embodiment of the utility knife blade herein described, the blade 10 is a composite utility knife as shown in FIG. 6. The blade 10 in this embodiment incorporates all of the features and advantages previously shown or described with respect to the embodiments of FIGS. 2-5 and FIGS. 7-8 and, therefore, can be used in conjunction with conventional industry standard retractable and fixed blade utility knives.

In the embodiment shown in FIG. 6, the blade 100 defines a back edge 112, a cutting edge 114 located on an opposite side of the blade relative to the back edge, and two side edges 116, 118 located on opposite sides of the blade relative to each other and extending between the back and cutting edges of the blade. As shown typically in FIG. 6, the back, cutting and side edges of the blade preferably define an approximately trapezoidal peripheral configuration. Additionally, the blade 100 defines a pair of score lines 130, 132, each of which is proximate to one of the side edges 116, 118 as shown. It should be noted that the score line configurations can vary as described above, so that the score lines 130, 132 can extend from the cutting edge 114 to the back edge 112 (as shown), from the cutting edge to the side edge (not shown), from the cutting edge to the point of intersection between the back and respective side edges (not shown) or any combination thereof; additionally, the score lines 130, 132 can run parallel to the side edges (not shown) or can run offset in a non-parallel manner (FIG. 6) as noted above. The blade 100 also defines at least one cutting segment and at least three cutting points and, in one embodiment, the blade 100 defines two cutting segments 134, 136 and four cutting points 140, 142, 144, and 146, all of which are defined in the same or similar manner as previously described.

The blade 10 further defines a first metal portion 120 and a second metal portion 122. As shown typically in FIG. 6, the first metal portion 120 extends between the back edge 112 and the second metal portion 122, and further extends from approximately one side edge 116 to the other side edge 118. The first metal portion 120 is formed of a steel, typically referred to as an "alloy" steel, that is heat treated to a surface hardness within the range of approximately 38 Rockwell "c" (referred to herein as "Rc") to approximately 52 Rc. The second metal portion 122 defines the cutting edge 114 and extends from approximately one side edge 116 to the other side edge 118. The second metal portion 122 is formed of a steel, typically referred to as a "high speed" or "tool" steel, that is heat treated to a surface hardness within the range of approximately 60 Rc to approximately 75 Rc.

The first metal portion 120 defines a spring-like backing that is relatively pliable, tough, and thus highly resistant to fatigue and cracking. The second metal portion 122, on the other hand, is relatively hard and highly wear resistant, and thus defines an ideal, long-lasting cutting blade. As a result, the composite utility knife blades 100 define highly wear-resistant, long-lasting cutting edges, combined with virtually unbreakable or shatter-proof backings.

The first metal portion 120 defines a spring-like backing that is relatively pliable, tough, and thus highly resistant to fatigue and cracking. The second metal portion 122, on the other hand, is relatively hard and highly wear resistant, and thus defines an ideal, long-lasting cutting blade. As a result, the composite utility knife blades 100 define highly wear-resistant, long-lasting cutting edges, combined with virtually unbreakable or shatter-proof backings.

As may be recognized by those skilled in the pertinent art based on the teachings herein, the currently preferred materials used to construct the first and second metal portions 120 and 122 and disclosed herein are only exemplary, and numerous other types of metals that are currently known or later become known for performing the functions of the first and/or second metal portions may be equally employed to form the composite utility knife blades.

As further shown in FIG. 6, each composite utility knife blade 100 defines a pair of cut outs or notches 124 formed in the back edge 112 and laterally spaced relative to each other. As shown typically in FIG. 6, each notch 124 defines a concave, approximately semi-circular profile, and is provided to engage a corresponding locator mounted within a conventional utility knife or knife holder (not shown) in order to retain the blade. As may be recognized by those skilled in the pertinent art based on the teachings herein, the notches 124 may take any of numerous different shapes and/or configurations, and the blade may include any number of such notches or other recesses that are currently known or later become known to those skilled in the pertinent art for performing the function of engaging a conventional utility knife or holder, or the blade actuating mechanism or locator of such a holder for any and all conventional utility knives that are currently known or later become known.

As also shown in FIG. 6, the blade 100 further defines a registration aperture 126 extending through the first metal portion in an approximately central portion of the blade. The registration aperture 126 is provided to receive a blade positioning device to position the blade in a die cutter during the process of making the blades and/or for positioning the blade in a conventional utility knife. As may be recognized by those skilled in the pertinent art based on the teachings herein, the aperture 126 may take any of numerous different shapes or configurations, and the blade may include any number of such apertures or other structural features for performing the function of properly positioning the blade in a die cutting or other manufacturing apparatus. In addition, the registration aperture(s) 126 may be located in any of numerous different locations on the utility knife blade 100.

As further shown in FIG. 6, the blade 100 defines a weld region 128 formed between the first and second metal portions 120 and 122, respectively, and defining an approximate line of joinder extending from one side edge 116 to the other side edge 118. The second metal portion 122 is joined to the first metal portion 120 by applying thermal energy to the interface, such as by electron beam welding, to thereby weld the first metal portion 120 to the second metal portion 122 and form a resulting weld region defining a line ofjoinder between the two different metal portions.

As also shown in FIG. 6, the cutting edge 114 defines an approximately straight edge extending from approximately one side edge 116 of the blade to the other side edge 118, and at least two facets (FIG. 2) formed on opposite sides of the blade relative to each other. However, the utility knife blade 100 may take any of numerous different shapes or configurations that are currently known or later become known, including, for example, a square or parallelogram shape, and can be single faceted or have more than two facets as previously noted.

Further details of the composite utility blades 100 and the manufacture of such blades are disclosed in the following patent and co-pending patent applications that are assigned to the assignee of the present invention and are hereby expressly incorporated by reference as part of the present disclosure: U.S. Pat. No. 6,701,627 issued Mar. 9, 2004, entitled "COMPOSITE UTILITY KNIFE BLADE AND METHOD OF MAKING SUCH A BLADE"; U.S. patent application Ser. No. 10/202,703 filed Jul. 24, 2002, entitled "Composite Utility Knife Blade and Method of Making Such a Blade"; and U.S. patent application Ser. No. 10/793,593 filed Mar. 4, 2004, entitled "COMPOSITE UTILITY BLADE AND METHOD OF MAKING SUCH A BLADE".

As may be recognized by those skilled in the pertinent art based on the teachings herein, the utility blades 10 and 100 may be made of any of numerous different material that are currently known or later become known, such as conventional carbon steel, bi-metal or other composite constructions, and/or may include any of numerous different coatings, such as wear-resistant coatings and/or decorative coatings.

As may be recognized by those skilled in the pertinent art based on the teachings herein, numerous changes and modifications may be made to the above—described and other embodiments of the four point utility knife blades herein described without departing from the scope of the invention as defined in the appended claims. For example, as shown in FIGS. 2, and 4-8, the blades may take any of numerous different shapes and/or configurations and the notches and score lines may be altered as previously noted.

Accordingly, this detailed description of preferred embodiments is to be taken in an illustrative, as opposed to a limiting sense.

What is claimed is:

1. A utility knife blade for use with conventional retractable and fixed blade utility knives comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective first cutting point, and the blade body defines no more than two score lines, wherein each score line is located proximate to a respective side edge and defines a respective removable cutting segment extending between the score line and the respective proximate side edge, and a second cutting point defined by the intersection of the respective score line and the cutting edge formed upon removal of the respective cutting segment from the utility knife blade;

wherein the second cutting point is laterally spaced a first distance from the first cutting point;

the blade body further defines two notches formed in the back edge thereof for engaging a blade-engaging device on a handle of the utility knife, the notches being laterally spaced relative to each other a second distance that is approximately equal to the first distance; and each of the score lines defines a respective side edge portion oriented at an acute angle relative to the cutting edge, and extends from one of (i) the cutting edge to the back edge, (ii) the cutting edge to the side edge proximate to the respective score line, and (iii) the cutting edge to the point of intersection between the back edge and the side edge proximate to the respective score line.

2. A utility knife blade for use with conventional retractable and fixed blade utility knives, comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective primary cutting point, and the blade body defines two score lines, wherein each score line is located proximate to a respective side edge, and each score line defines a respective removable cutting segment extending between the score line and the respective proximate side edge, a respective secondary cutting point at the intersection of the respective score line and the cutting edge, and a side edge portion oriented at an acute angle relative to the cutting edge that is formed upon removal of the respective cutting segment from the utility knife blade, and wherein the secondary cutting point is laterally spaced a first distance from the proximate primary cutting point; and wherein the blade body further defines two notches formed in the back edge thereof for engaging a blade-engaging device on a handle of the utility knife, wherein the notches are laterally spaced relative to each other a second distance that is approximately equal to the first distance so that the blade-engaging device may engage one notch for positioning a primary cutting point a first extended position distance from the utility knife handle, and the blade-engaging device may engage the other notch for positioning a secondary cutting point a second extended position distance from the utility knife handle that is approximately equal to the first extended position distance.

3. The utility knife blade of claim 2, further defining at least four notches formed in the back edge of the blade body and having a center point, wherein the at least four notches are laterally spaced relative to each other.

4. The utility knife blade of claim 3, further defining a distance D1 between each proximate primary and secondary cutting point and a blade aperture defined by the utility knife handle that the blade is mounted into, a distance D2 between the center points of the notches, and a distance D3 between the proximate primary and secondary cutting points and any proximate secondary cutting points, wherein D2 and D3 are approximately equal to one another such that, upon removal of the cutting segments, the blade can be indexed so that the secondary cutting points extend from the blade aperture a distance D4, which is approximately equal to D1.

5. The utility knife blade of claim 4, wherein D2 and D3 are approximately 1/10 to 1/2 inch.

6. The utility knife blade of claim 5, wherein D2 and D3 are approximately 1/4 inch.

7. The utility knife blade of claim 1, wherein each side edge intersects the cutting edge at an acute angle relative to the cutting edge and each score line intersects the cutting edge at an acute angle relative to the cutting edge.

8. The utility knife blade of claim 1, wherein the cutting edge defines an approximately straight edge extending from approximately one side edge of the blade to the other side edge, and at least two facets formed on opposite sides of the blade relative to each other.

9. The utility knife blade of claim 1, further defining at least one notch formed at the juncture of each score line and the cutting edge to facilitate removing the respective cutting segment from the blade.

10. The utility knife blade of claim 1, further defining at least one aperture in the blade body.

11. A utility knife blade for use with conventional retractable and fixed blade utility knives comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective first cutting point;

first and second metal portions, wherein the first metal portion extends between the back edge and the second metal portion, and extends from approximately one side edge to the other side edge, and is formed of a steel heat treated to a hardness within the range of approximately 38 Rc to approximately 52 Rc, and the second metal portion defines the cutting edge and extends from approximately one side edge to the other side edge, and is formed of a tool steel heat treated to a hardness within the range of approximately 60 Rc to approximately 75 Rc; and a weld region joining the first and second metal portions and extending from approximately one side edge to the other side edge of the blade;

wherein the blade body defines no more than two score lines, each score line is located proximate to a respective side edge, and each score line defines a respective removable cutting segment extending between the score line and the respective proximate side edge, a second cutting point at the intersection of the respective score line and the cutting edge, and a side edge portion oriented at an acute angle relative to the cutting edge that is formed upon removal of the respective cutting segment from the utility knife blade; and wherein each of the score lines extends from one of (i) the cutting edge to the back edge, (ii) the cutting edge to the side edge proximate to the respective score line, and (iii) the cutting edge to the point of intersection between the back edge and the side edge proximate to the respective score line;

and further defining:

one of (i) two notches formed in the back edge of the blade body and having a center point, wherein the two notches are laterally spaced relative to each other, and (ii) four notches formed in the back edge of the blade body and having a center point, wherein the four notches are laterally spaced relative to each other; and a distance D1 between each first cutting point and a blade aperture defined by a handle of the utility knife that the blade is mounted into, a distance D2 between the center points of the notches, and a distance D3 between the first and second cutting points and between any additional proximate second cutting points, wherein D2 and D3 are approximately equal to one another such that, upon removal of the cutting segments, each second cutting point extends from the blade aperture a distance D4, which is approximately equal to D1.

12. The utility knife blade of claim 11, wherein D2 and D3 are approximately 1/10 to 1/2 inch.

13. The utility knife blade claim 12, wherein D2 and D3 are approximately 1/4 inch.

14. The utility knife blade of claim 11, wherein each side edge intersects the cutting edge at an acute angle relative to the cutting edge and each score line intersects the cutting edge at an acute angle relative to the cutting edge.

15. The utility knife blade of claim 11, wherein the cutting edge defines an approximately straight edge extending from approximately one side edge of the blade to the other side edge, and at least two facets formed on opposite sides of the blade relative to each other.

16. The utility knife blade of claim 11, further defining at least one notch formed at the juncture of each score line and the cutting edge to facilitate removing the respective cutting segment from the blade.

17. The utility knife blade of claim 11, further defining at least one aperture in the blade body.

18. A utility knife blade for use with conventional retractable and fixed blade utility knives, wherein a handle of the utility knife defines a blade aperture for passage of the utility knife blade therethrough, and an edge forming the blade aperture, the utility knife blade comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective primary cutting point;

a score line proximate to a respective side edge of the blade;

a removable cutting segment defined by an area of the blade body between the score line and the side edge proximate to the score line; and a secondary cutting point formed by the intersection of the score line and the cutting edge when the cutting segment is removed, wherein the secondary cutting point is laterally spaced a first distance from the primary cutting point;

the blade body further defines two notches formed in the back edge thereof for engaging a blade-engaging device on the handle of the utility knife, the notches being laterally spaced relative to each other a second distance that is approximately equal to the first distance; and the score line defines a respective side edge portion oriented at an acute angle relative to the cutting edge, and extends from one of (i) the cutting edge to the back edge, (ii) the cutting edge to the side edge proximate to the respective score line, and (iii) the cutting edge to the point of intersection between the back edge and the side edge proximate to the respective score line, and wherein the score line is oriented on the blade body transverse to the edge forming the blade aperture of the utility knife handle.

19. The utility knife blade of claim 18, further comprising:

first and second metal portions, wherein the first metal portion extends between the back edge and the second metal portion, and extends from approximately one side edge to the other side edge, and is formed of a steel heat treated to a hardness within the range of approximately 38 Rc to approximately 52 Rc, and the second metal portion defines the cutting edge and extends from approximately one side edge to the other side edge, and is formed of a tool steel heat treated to a hardness within the range of approximately of Rc to approximately 75 Rc; and a weld region joining the first and second metal portions and extending from approximately one side edge to the other side edge of the blade.

20. The utility knife blade of claim 18, wherein the blade body defines no more than two score lines, each score line is located proximate to a respective side edge and defines a respective removable cutting segment extending between the score line and the respective proximate side edge, and a secondary cutting point defined by the intersection of the respective score line and the cutting edge formed upon removal of the respective cutting segment from the utility knife blade.

21. The utility knife blade of claim 18, wherein the blade body defines two score lines, each score line is located proximate to a respective side edge and defines a respective removable cutting segment extending between the score line and the respective proximate side edge, and a secondary cutting point defined by the intersection of the respective score line and the cutting edge formed upon removal of the respective cutting segment from the utility knife blade, each secondary cutting point is laterally spaced the first distance from the proximate primary cutting point; and the blade-engaging device may engage one notch for positioning a first cutting point a first extended position distance from the utility knife handle, and the blade-engaging device may engage the other notch for positioning a secondary cutting point a second extended position distance from the utility knife handle that is approximately equal to the first extended position distance.

22. The utility knife blade of claim 18, wherein each score line intersects the cutting edge at an acute angle relative to the cutting edge.

23. A utility knife blade for use with conventional retractable and fixed blade utility knives, comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective primary cutting point, and the blade body includes no more than two means for forming (i) a respective removable cutting segment extending between the respective means and the proximate side edge, (ii) a secondary cutting point at the intersection of the respective means and the cutting edge, and (iii) a side edge portion oriented at an acute angle relative to the cutting edge, upon removal of the respective cutting segment from the utility knife blade, and wherein each means extends from one of (i) the cutting edge to the back edge, (ii) the cutting edge to the side edge proximate to the respective means, and (iii) the cutting edge to the point of intersection between the back edge and the side edge proximate to the respective means;

wherein the secondary cutting point is laterally spaced a first distance from the primary cutting point; and the blade body further defines two notches formed in the back edge thereof for engaging a blade-engaging device on a handle of the utility knife, the notches being laterally spaced relative to each other a second distance that is approximately equal to the first distance.

24. The utility knife blade of claim 23, wherein each means is a respective score line.

25. The utility knife blade of claim 23, wherein each means intersects the cutting edge at an acute angle relative to the cutting edge.

26. The utility knife blade of claim 23, wherein each means extends from the cutting edge to the side edge proximate to the respective means.

27. The utility knife blade of claim 1, wherein each score line extends from the cutting edge to the side edge proximate to the respective score line.

28. The utility knife blade of claim 7, wherein each score line and the respective proximate side edge are offset at an angle.

29. The utility knife blade of claim 9, wherein the notch defines the acute angle.

30. The utility knife blade of claim 11, wherein each score line extends from the cutting edge to the side edge proximate to the respective score line.

31. The utility knife blade of claim 14, wherein each score line and the respective proximate side edge are offset at an angle.

32. The utility knife blade of claim 16, wherein the notch defines the acute angle.

33. The utility knife blade of claim 18, wherein the score line extends from the cutting edge to the side edge proximate to the respective score line.

34. A utility knife blade for use with conventional retractable and fixed blade utility knives, comprising:

a generally planar blade body having a substantially trapezoidal peripheral configuration, the blade body defining a back edge, a cutting edge located on an opposite side of the blade body relative to the back edge, and two side edges located on opposite sides of the blade body relative to each other and extending between the back and cutting edges of the blade body, wherein the intersection of each side edge and the cutting edge forms a respective primary cutting point, and the blade body defines at least one score line, wherein each score line is located proximate to a respective side edge, and each score line defines a respective removable cutting segment extending between the score line and the respective proximate side edge, a respective secondary cutting point at the intersection of the respective score line and the cutting edge, and a side edge portion oriented at an acute angle relative to the cutting edge that is formed upon removal of the respective cutting segment from the utility knife blade, and wherein the secondary cutting point is laterally spaced a first distance from the proximate primary cutting point; and wherein the blade body further defines at least two notches formed in the back edge thereof for engaging a blade-engaging device on a handle of the utility knife, wherein adjacent notches are laterally spaced relative to each other a second distance that is approximately equal to the first distance so that the blade-engaging device may engage at least one notch for positioning a primary cutting point a first extended position distance from the utility knife handle, and the blade-engaging device may engage at least one adjacent notch for positioning a secondary cutting point a second extended position distance from the utility knife handle that is approximately equal to the first extended position distance.

35. The utility knife blade of claim 34, wherein each score line and the respective proximate side edge are offset at an angle, and wherein each score line is oriented such that after removal of the respective cutting segment the utility knife blade retains its substantially trapezoidal peripheral configuration.

* * * * *